United States Patent [19]

Butscher et al.

[11] Patent Number: 4,605,932

[45] Date of Patent: Aug. 12, 1986

[54] NESTED MICROSTRIP ARRAYS

[75] Inventors: Frank D. Butscher, San Jose; Michael J. Gegan, Menlo Park, both of Calif.

[73] Assignee: The United States of America as represented by the Secretary of the Navy, Washington, D.C.

[21] Appl. No.: 618,013

[22] Filed: Jun. 6, 1984

[51] Int. Cl.[4] ..... H01Q 1/38

[52] U.S. Cl. ..... 343/700 MS; 343/708

[58] Field of Search ..... 343/700 MS, 705, 708, 343/769, 829, 846

[56] References Cited

U.S. PATENT DOCUMENTS

| | | | |
|---|---|---|---|
| 3,977,004 | 8/1976 | Bickel | 343/705 |
| 4,051,480 | 9/1977 | Reggia et al. | 343/705 |
| 4,070,676 | 1/1978 | Sanford | 343/829 |
| 4,089,003 | 5/1978 | Conroy | 343/700 MS |
| 4,162,499 | 7/1979 | Jones, Jr. et al. | 343/700 MS |
| 4,218,682 | 8/1980 | Yu | 343/700 MS |
| 4,305,078 | 12/1981 | Jones, Jr. et al. | 343/708 |
| 4,316,194 | 2/1982 | De Santis et al. | 343/846 |
| 4,326,203 | 4/1982 | Kaloi | 343/700 MS |
| 4,329,689 | 5/1982 | Yee | 343/829 |

FOREIGN PATENT DOCUMENTS

| | | | |
|---|---|---|---|
| 57-91003 | 6/1982 | Japan | 343/700 MS |

*Primary Examiner*—Eli Lieberman
*Assistant Examiner*—Michael C. Wimer
*Attorney, Agent, or Firm*—R. F. Beers; C. D. B. Curry; W. C. Daubenspeck

[57] ABSTRACT

An antenna structure in which two or more microstrip arrays are disposed on top of each other to minimize the required space. The shape of the microstrip elements and the polarization thereof are chosen so that the individual elements radiate only in specific areas along the edges of the elements with the remainder of the element having no appreciable electric field concentration. Because of the operating frequency of a microstrip element is a function of the size of the element, a second antenna of smaller higher-frequency elements may be disposed over a larger lower-frequency antenna such that the higher frequency antenna does not cover the areas of the lower antenna that radiate but lies over only those areas having no appreciable electric fields concentrations. Increasingly higher-frequency antennas can be placed on top of the lower-frequency antennas if the foregoing conditions are maintained with respect to all of the covered antennas. This arrangement permits separate feed networks and omnidirectional coverage or directional coverage for each of the arrays independent of the others.

10 Claims, 7 Drawing Figures

NESTED MICROSTRIP ARRAYS

BACKGROUND OF THE INVENTION

This invention relates in general to microstrip antennas and, in particular, to a compact microstrip antenna structure for employing two or more microstrip arrays to provide a multiband antenna system.

In aircraft and aerospace applications, there is frequently a need for two or more antennas to operate at widely spaced frequencies or in separate frequency bands. At the same time, space and weight limitations are often critical. Therefore, it is highly desirable to minimize space and weight required for the antenna system while providing multiband or multifrequency coverage. The advantages of microstrip antennas are well-known. Among other features, microstrip antennas provide antennas having light weight, ruggedness, low physical profile, simplicity, low cost, and conformal arraying capability. The present invention provides an antenna structure having the advantages of microstrip antennas while minimizing the space required for multiband operations.

SUMMARY OF THE INVENTION

It is an object of the present invention to provide an antenna system suitable for use in aircraft and aerospace applications having very strict space and weight limitations.

Another object is to provide an antenna system in which multiple band operation is provided within a single aperture.

Another object is to provide an antenna structure in which the space required for the antenna system is only as large as space required for the antenna having the lowest operating frequency.

Still another object is to provide the foregoing objects in an antenna system providing omnidirectional coverage or directional coverage for each frequency band independent of the other frequency bands.

These and other objects, advantages, and features are provided by an antenna structure in which two or more microstrip arrays are disposed on top of each other to minimize the required space. The shape of the microstrip elements and the polarization thereof are chosen so that the individual elements radiate only in specific areas along the edges of the elements with the remainder of the element having no appreciable electric field concentrations. For example, microstrip disk elements or rectangular elements may be fed so that the individual elements radiate only along two opposing edges. Because the operating frequency of a microstrip element is a function of the size of the element, a second antenna of smaller higher-frequency elements may be disposed over a larger lower-frequency antenna such that the higher frequency antenna does not cover the areas of the lower antenna that radiate but lies over only those areas having no appreciable electric field concentrations. Increasingly higher-frequency antennas can be placed on top of the lower-frequency antennas if the foregoing conditions are maintained with respect to all of the covered antennas. This arrangement permits separate feed networks and omnidirectional coverage or directional coverage for each of the arrays independent of the others.

Other advantages and features of the present invention will become apparent from the following detailed description when considered in conjunction with the accompanying drawings wherein:

DESCRIPTION OF THE PREFERRED EMBODIMENT

Figure 1:
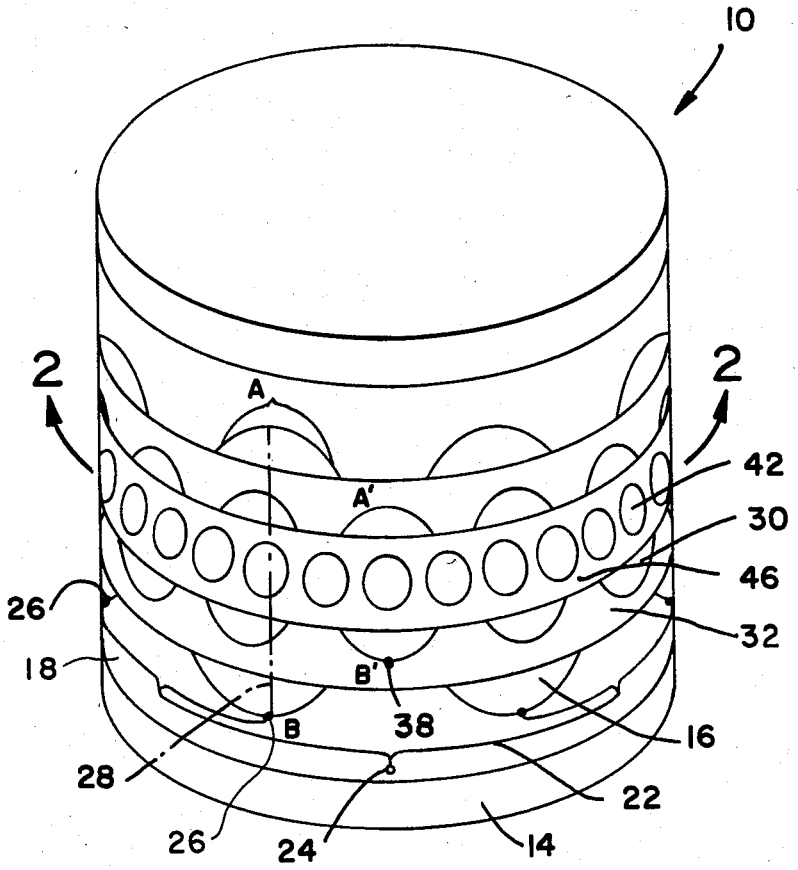
FIG. 1 is a perspective view illustrating an antenna system according to the present invention.
Figure 2:
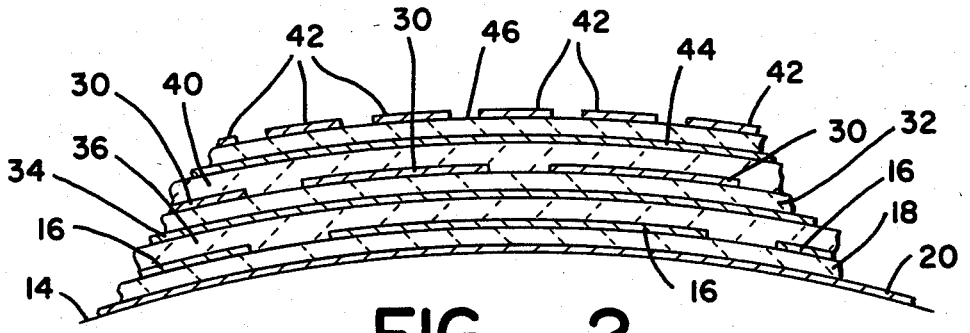
FIG. 2 is a partial sectional view taken along lines 2' 2' in FIG. 1.

Referring now to the drawings, FIGS. 1 and 2 show a section of a cylindrical structure 10 such as a missile body having three microstrip disk arrays disposed around its circumference according to the present invention. The first microstrip array, which has the lowest operating frequency and thus the radiating elements having the largest diameter, is mounted on the surface 14 of the supporting structure 10 in the conventional manner. This lowest frequency array includes microstrip disk elements 16 fabricated on a thin low-loss dielectric substrate 18 which is disposed on a ground plane 20 in the conventional manner. The disk radiating elements 16 are fed through a microstrip corporate feed network 22 which is fed through a conventional coaxial-to-microstrip launcher 24. The microstrip transmission lines of corporate feed 22 are connected to the disk radiating elements 16 at feed points 26 located on the vertical center lines 28 of the radiating elements. Alternatively, the disk radiating elements 16 may be individually fed at feed points 26 located on line 28 by coaxial-to-microstrip launchers.

When properly fed at feed points located in the vicinity of the vertical center lines 28, the disk radiating elements 16 radiate primarily in areas A and B which are located along the edges of the radiating elements in the vicinity of the centerlines. Little or no radiation is exhibited at other areas on the surface of the disks 16. It will be recognized that this type of electric field pattern in which electric fields are present only along two opposing edges of the element may be accomplished with elements of various shapes when properly fed.

A second smaller, higher-frequency, microstrip array may be disposed on top of the first array as long as it is located over the areas in which the lower array does not radiate. As shown in FIGS. 1 and 2, the second array is of conventional design having microstrip disk elements 30 fabricated on a dielectric substrate 32 which is disposed on a ground plane 34. The ground plane 34 of the second array is not directly placed on the top surface of the first array but is isolated therefrom by a thin low-loss dielectric substrate 36.

The feed network of the second array and subsequent arrays are not shown in the drawings for purposes of clarity. As in the case of the first array, the second array may be fed by a microstrip corporate feed network or each element may be individually fed by coaxial-to-microstrip launchers. The radiating elements 30 of the second array are fed at feed points 38 selected is the same manner as the feed points 26 were selected for the first array. That is, the radiating elements 30 are fed so that radiation is present only along the two opposing edges A' and B' of the elements.

A third, smaller, higher-frequency array may be disposed on top of the second array as long as it is located over the areas in which the arrays below it do not radiate. The third array, which is isolated from the second array by a thin, low-loss dielectric substrate 40, is is of conventional design, having microstrip disk elements 42 separated from a ground plane 44 by a dielectric layer 46.

Additional even smaller arrays can be placed over the third array as long as each lower array is properly fed until a practical size limit is reached. The top most array may be fed to produce any radiation pattern as long as the array itself is not located on areas of the lower array that radiate.

Figure 3:
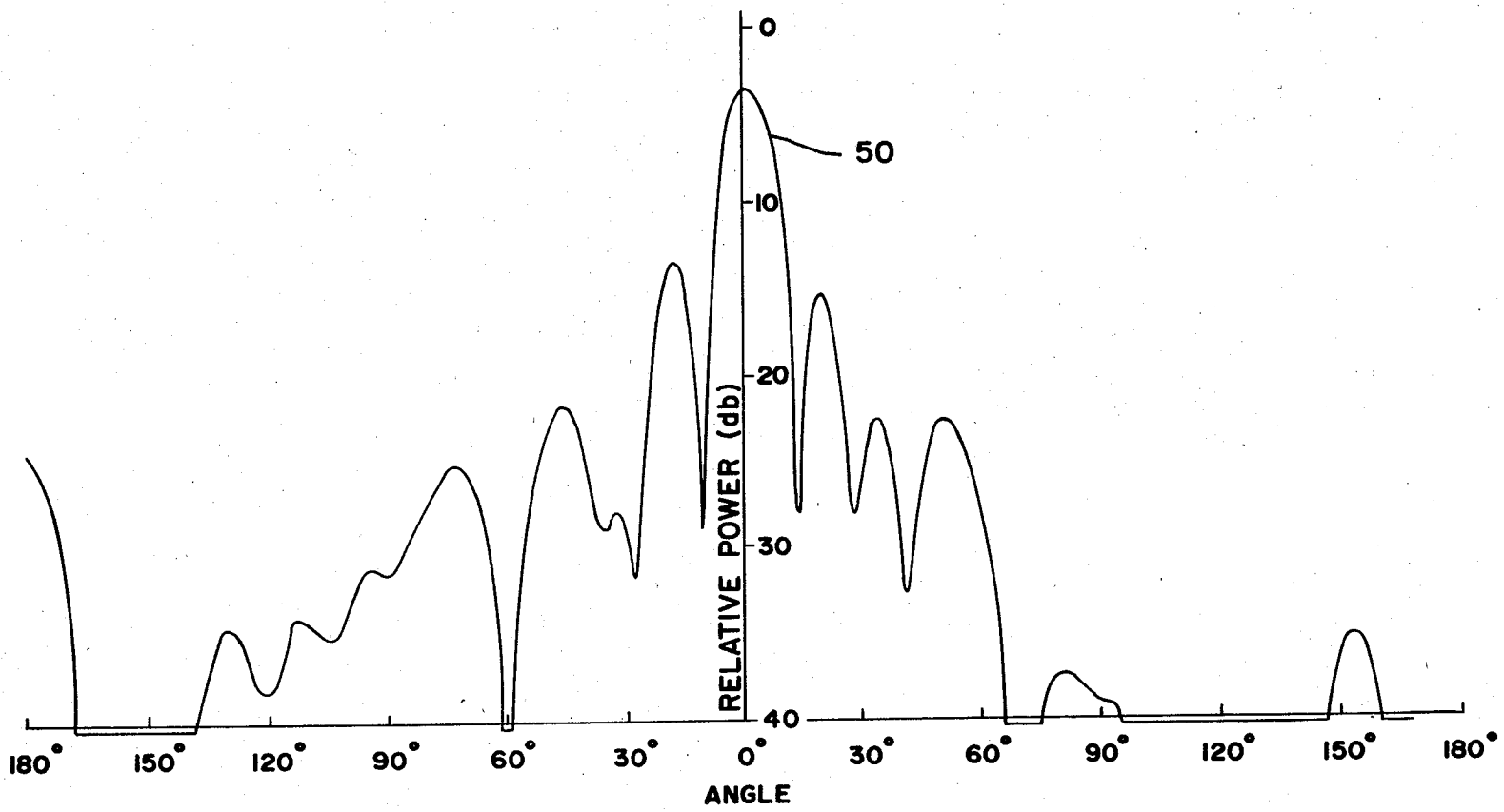
FIG. 3 is a plot of the far field H-plane radiation pattern of a higher frequency one-eighth section array disposed on a lower frequency array in accordance with the present invention.

FIGS. 3–7 are plots of radiation patterns obtained in tests to verify the operation an antenna system according to the invention. Two antennas were used. The larger antenna was a circular array consisting of sixteen rectangular elements approximately 9¼ inches by 8 inches having a nominal operating frequency of 397 MHz. The microstrip elements were spaced ¼ inch from the ground plane. The smaller antenna was an array of eight elements approximately 4 inches by 2¼ inches having a nominal operating frequency of 1575 MHz. The far field H-plane plot 50 of FIG. 3 was obtained when the smaller antenna was disposed on top of a section of the larger antenna and excited at its nominal operating frequency. Since the plot of FIG. 3 shows the expected pattern for the smaller array alone, it was concluded that exciting the smaller array does not excite unwanted modes in the larger antenna. It is assumed that the smaller antenna (1575 MHz) would not be expected to support excitation at the frequency (397 MHz) of the larger antenna.

Figure 4:
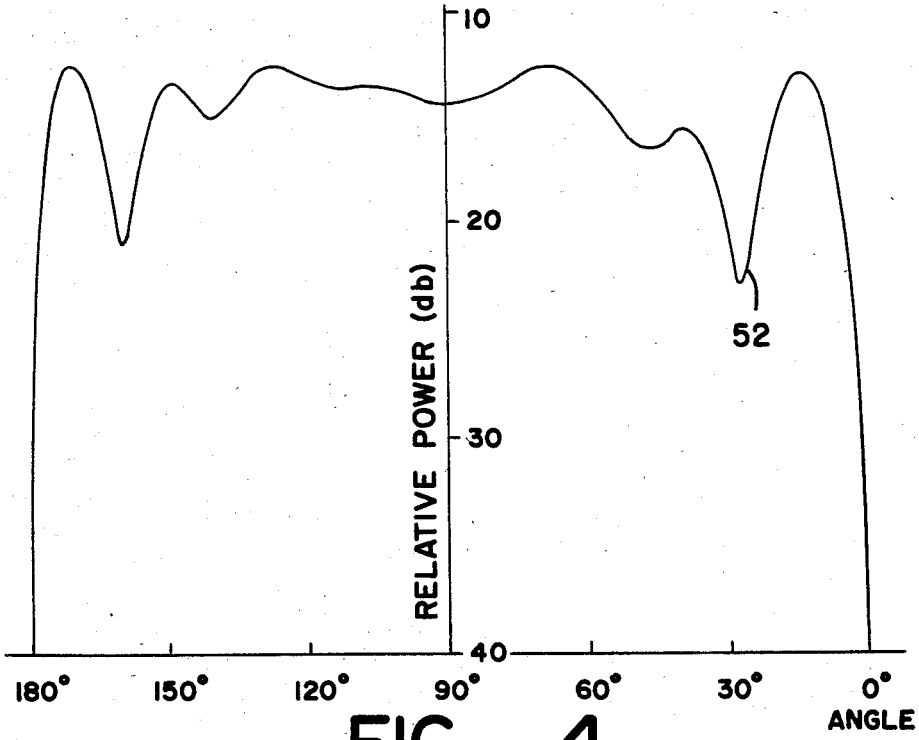
FIG. 4 is a plot of the far field E-plane radiation pattern of the lower frequency array.
Figure 5:
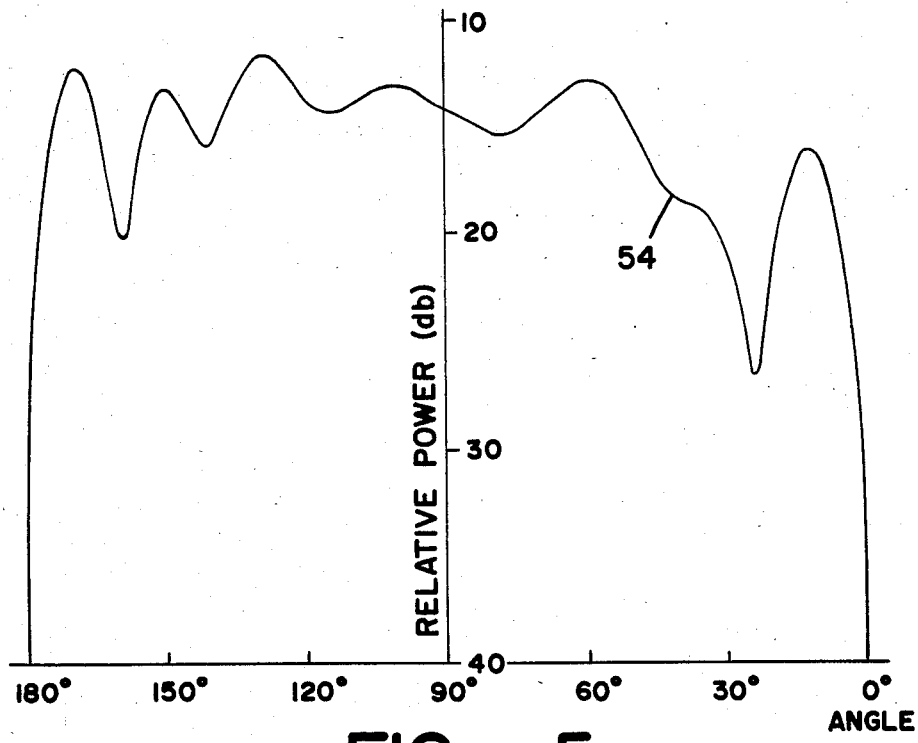
FIG. 5 is a plot of the far field E-plane radiation pattern of the lower frequency array with the higher frequency array disposed on top of it according to the present invention.
Figure 6:
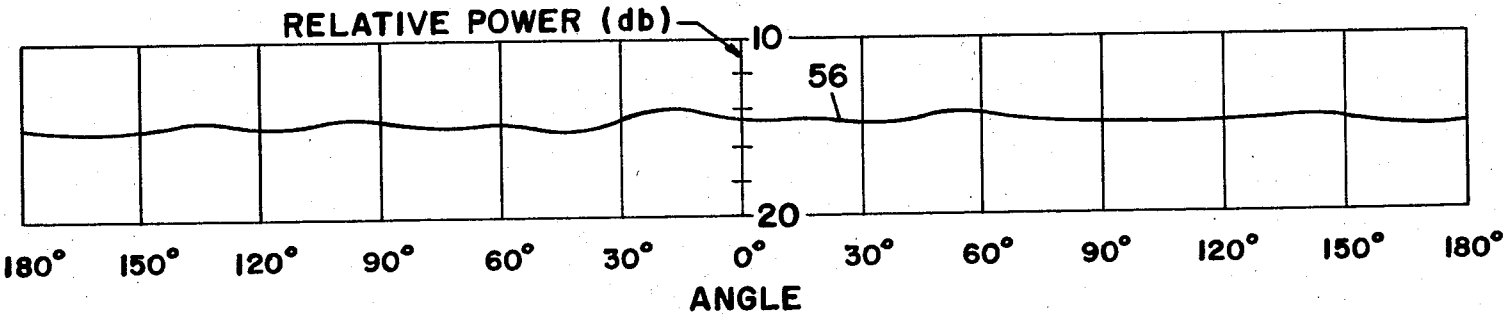
FIG. 6 is a plot of the far field H-plane radiation pattern of the lower frequency array.
Figure 7:
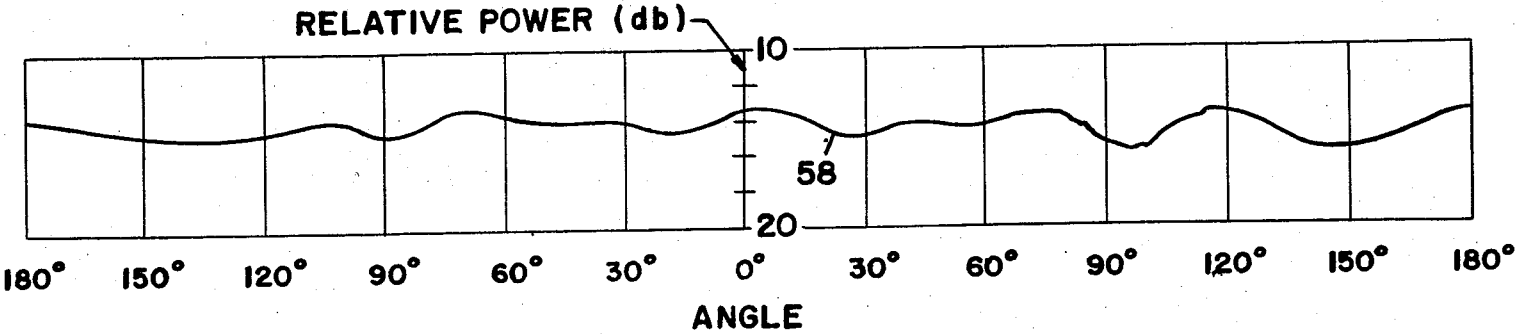
FIG. 7 is a plot of the far field H-plane radiation pattern of the lower frequency array with the higher frequency array disposed on top of it according to the present invention.

FIGS. 4–7 illustrate the effect that the smaller antenna has on the operation of the larger antenna. FIG. 4 shows an E-plane far field pattern 52 for the larger 16-element array alone excited at 397 MHz. FIG. 5 shows an E-plane far field pattern 54 for the larger 16-element array with a five inch ground plane disposed on top of the lower array at the center with a spacing of 1/16 inch. Similarly, FIG. 6 shows an H-plane far field pattern 56 for the 16-element array alone and FIG. 7 shows an H-plane far field pattern 58 with the five inch ground plane disposed on top of the lower array. It can be seen that the radiation pattern of the larger array is not appreciably changed by the presence of the smaller array on top of it. However, the presence of the ground plane produced an increase in the nominal frequency of the antenna from 397 MHz to 423 MHz. It has been found that, as the separation of the antennas increases, the detuning of the lower antenna decreases.

It can be seen that the present invention provides an antenna system that has advantages of microstrip antennas in general. Each array may be individually driven to provide onmidirectional or directional coverage. Both independent feed or corporate feed networks may be used. The antenna system only requires as much space as that required for the antenna having the lowest operating frequency.

Obviously many modifications and variations of the present invention are possible in the light of the above teachings. It is therefore to be understood that within the scope of the appended claims the invention may be practiced otherwise than as specifically described.

What is claimed is:

1. A microstrip antenna system comprising:

(a) a first microstrip antenna for operating in a first frequency band, said first antenna having at least one microstrip radiating element spaced from a ground plane by a dielectric substrate, said at least one radiating element having a feed point located so that electric fields are present only in specific areas along the edges of said at least one element with the remainder of said at least one element having no appreciable electric field concentration;

(b) a second microstrip antenna for operating in a second higher frequency band, said second antenna having at least one microstrip radiating element spaced from a ground plane by a dielectric substrate, said second microstrip antenna being disposed over said first microstrip antenna so that said second microstrip antenna covers only areas of said first microstrip antenna having no appreciable electric field concentration; and (c) a dielectric layer separating the ground plane of said second antenna from said first antenna.

2. An antenna system as called for in claim 1 wherein said at least one radiating element of said second antenna has a feed point located so that electric fields are present only in specific areas along the edges of said at least one element with the remainder of said at least one element having no appreciable electric field concentration; said antenna system further comprising:

(a) a third microstrip antenna for operating in a third still higher frequency band, said third antenna having at least one microstrip radiating element spaced from a ground plane by a dielectric substrate, said third microstrip antenna being disposed over said said second microstrip antenna so that said third microstrip antenna covers only areas of said first and second microstrip antennas having no appreciable electric field concentration; and (c) a dielectric layer separating the ground plane of said third antenna from said second antenna.

3. Apparatus as recited in claim 1 wherein:

(a) said first microstrip antenna includes an array of microstrip elements; and (b) said second microstrip antenna includes an array of microstrip elements.

4. Apparatus as recited in claim 2 wherein:

(a) said first microstrip antenna includes an array of microstrip elements; and (b) said second microstrip antenna includes an array of microstrip elements.

5. Apparatus as recited in claim 4 wherein said third microstrip antenna includes an array of microstrip elements.

6. Apparatus as recited in claim 1 wherein the feed point of said first antenna is located so that the electric fields are present only along two opposing edges of said at least one element.

7. Apparatus as recited in claim 2 wherein:

(a) the feed point of said first antenna is located so that the electric fields are present only along two opposing edges of said at least one element; and (b) the feed point of said second antenna is located so that the electric fields are present only along two opposing edges of said at least one element.

8. Apparatus as recited in claim 1 wherein said at least one microstrip radiating element of said first antenna is a disk, said disk having a feed point located on its centerline to produce linear polarization and electric fields located only on the opposing edges of said disk in the region of said centerline; and wherein said at least one microstrip radiating element of said second antenna is a disk.

9. A microstrip antenna system comprising:

(a) a first microstrip array antenna for operating in a first frequency band, said first antenna including a ground plane, a dielectric substrate disposed on said ground plane, and a plurality of microstrip radiating elements disposed on said dielectric substrate, said radiating elements being sized to support a first operating frequency, each said radiating element having its feed point located on its centerline so that electric fields are present only along the edges of said element in the vicinity of said centerline with the remainder of said radiating element having no appreciable electric field concentration;

(b) a second smaller microstrip antenna array for operating in a second higher frequency band, said second antenna including a ground plane, a dielectric substrate disposed on said ground plane, and a plurality of microstrip radiating elements disposed on said dielectric substrate, said radiating elements of the second microstrip antenna being sized to support a second operating frequency, said second microstrip antenna being disposed over said first microwave antenna so that said second microstrip antenna covers only areas of said first microstrip antenna having no appreciable electric field concentration; and (c) a dielectric layer separating the ground plane of said second antenna from said first antenna.

10. A microstrip antenna system as recited in claim 9 wherein each radiating element of said second microstrip antenna has its feed point located on its centerline so that electric fields are present only along the edges of said element in the vicinity of said centerline with the remainder of said radiating element having no appreciable electric field concentration; and further comprising:

(a) a third microstrip array antenna for operating in a third frequency band, said third frequency band being higher than said second frequency band, said third antenna including a ground plane, a dielectric substrate disposed on said ground plane, and a plurality of microstrip radiating elements disposed on said dielectric substrate, said radiating elements of the third microstrip antenna being sized to support a third operating frequency, said third microstrip antenna being disposed over said second microstrip antenna so that said third microstrip antenna covers only areas of said first and second microstrip antennas having no appreciable electric field concentration; and (b) a dielectric layer separating the ground plane of said third antenna from said second antenna.

* * * * *